US007362058B2

(12) United States Patent
Gibson et al.

(10) Patent No.: US 7,362,058 B2
(45) Date of Patent: Apr. 22, 2008

(54) METHOD AND DEVICE FOR CONTROLLING THE LIGHT INTENSITY IN A MULTI-LAMP ILLUMINATION DEVICE FOR A DISPLAY PANEL

(75) Inventors: Neil Gibson, Freising (DE); Juergen Neuhaeusler, Bad Aibling (DE)

(73) Assignee: Texas Instruments Deutschland GmbH, Dallas, TX (US)

( * ) Notice: Subject to any disclaimer, the term of this patent is extended or adjusted under 35 U.S.C. 154(b) by 0 days.

(21) Appl. No.: 11/353,888

(22) Filed: Feb. 14, 2006

(65) Prior Publication Data

US 2006/0181224 A1 Aug. 17, 2006

(30) Foreign Application Priority Data

Feb. 16, 2005 (DE) ..... 10 2005 007 109

(51) Int. Cl.
*H05B 41/16* (2006.01)
*H05B 37/02* (2006.01)

(52) U.S. Cl. ..... 315/246; 315/291; 315/307

(58) Field of Classification Search ..... 315/209 R, 315/224, 246, 247, 291, 307–308, 312
See application file for complete search history.

(56) References Cited

U.S. PATENT DOCUMENTS 6,008,593 A * 12/1999 Ribarich ..... 315/307
6,075,325 A 6/2000 Kouno et al.
6,445,137 B1 * 9/2002 Okamoto et al. ..... 315/246
6,501,234 B2 12/2002 Lin et al.
7,084,583 B2 * 8/2006 Hur et al. ..... 315/291
7,211,966 B2 * 5/2007 Green et al. ..... 315/224
2002/0171365 A1 * 11/2002 Morgan et al. ..... 315/56
2003/0178951 A1 * 9/2003 Park et al. ..... 315/312
2004/0183469 A1 * 9/2004 Lin et al. ..... 315/247
2005/0017654 A1 * 1/2005 Miller ..... 315/247
2005/0029967 A1 2/2005 Chen et al.
2006/0006811 A1 * 1/2006 Green et al. ..... 315/209 R
2006/0097661 A1 * 5/2006 Johnsen et al. ..... 315/291

FOREIGN PATENT DOCUMENTS

EP 1213699 6/2002
EP 1255241 11/2002
EP 1489590 12/2004

* cited by examiner

*Primary Examiner*—Thuy V. Tran
*Assistant Examiner*—Tung X Le
(74) *Attorney, Agent, or Firm*—Wade J. Brady, III; Frederick J. Telecky, Jr.

(57) ABSTRACT

For controlling the light intensity in a multi-lamp illumination device an automatic sequencing of the PWM dimming distributes the burst dimming pulses during the display's frame period. Specifically, the method includes the steps of generating a plurality of synchronized pulse-width modulated lamp activation signals of equal duty-cycles; individually controlling the phase of each lamp activation signal within the frame periods; and separately supplying each lamp of the illumination device with one of the lamp activation signals. The lamp activation signals are preferably all derived from a common pulse-width modulated intensity control signal. By evenly distributing the lamp activation signals, or pulses, within the display's frame period, the EMI emission is minimized, the refresh rate is artificially enhanced, and the peak to average current is reduced.

6 Claims, 2 Drawing Sheets

METHOD AND DEVICE FOR CONTROLLING THE LIGHT INTENSITY IN A MULTI-LAMP ILLUMINATION DEVICE FOR A DISPLAY PANEL

CROSS REFERENCE TO RELATED APPLICATIONS

This application claims priority under 35 USC § 119 of German Application Serial No. 10 2005 007 109.0, filed Feb. 16, 2005.

FIELD OF THE INVENTION

The present invention relates to a method of and a device for controlling the light intensity in a multi-lamp illumination device for a display panel.

BACKGROUND OF THE INVENTION

Conventional display panels such as an LCD display panel with backlight illumination use a multi-lamp cold cathode fluorescent system. The light intensity of the backlight illumination is controlled by pulse-width modulation (PWM) of the lamp supply current. Modulating the light intensity in all lamps concurrently results in constant electromagnetic interference (EMI) emission irrespective of light intensity. The peak to average current ratio is also high, which translates into a higher cost system power supply.

SUMMARY OF THE INVENTION

The present invention provides a method of controlling the light intensity in a multi-lamp illumination device that permits an automatic sequencing of the PWM dimming to distribute the burst dimming pulses during the display's frame period. Specifically, the method comprises the steps of generating a plurality of synchronized pulse-width modulated lamp activation signals of equal duty-cycles; individually controlling the phase of each lamp activation signal within the frame periods; and separately supplying each lamp of the illumination device with one of the lamp activation signals. The lamp activation signals are preferably all derived from a common pulse-width modulated intensity control signal.

By evenly distributing the lamp activation signals, or pulses, within the display's frame period, the EMI emission is minimized, the refresh rate is artificially enhanced and the peak to average current is reduced.

In another aspect of the invention the lamp activation signals overlap each other within the frame periods. In addition, the lamp activation signals are determined by image tracking.

The device for controlling the light intensity in a multi-lamp illumination device for a display panel, includes a display controller that supplies a pulse-width modulated intensity control signal; and a plurality of lamp controllers, each associated with one lamp of the display panel and each receiving the pulse-width modulated intensity control signal from the display controller. Each lamp controller has a master/slave control input and a phase control input. Each lamp controller also has a logic control circuit that switches the lamp controller between a master mode and a slave mode in response to the master/slave control signal. An output multiplexer in each lamp controller has a select input connected to a select control output of the logic control circuit, a plurality of signal inputs and a lamp activation output, one of the signal inputs receiving the intensity control signal. A phase lock loop in the lamp controller has an output that, in the slave mode, is locked to the intensity control signal. A phase control circuit in the lamp controller has a first input connected to the output of the phase lock loop, a second input connected to the phase control input and an output connected to a signal input of the output multiplexer. The output multiplexer, in the master mode, routes the intensity control signal to the lamp activation output and, in the slave mode, passes to the lamp activation output a signal the phase of which is determined by the phase control circuit. Each lamp controller receives a master/slave control signal and a phase control signal from the display controller. As is understood, the device includes plural lamp controllers which may all be identical, although they may operate in either of the master and slave modes and may supply lamp activation pulses with a rising edge the position of which within the frame period can be adjusted individually. The design of the inventive device is flexible and allows an implementation of all variants of the inventive method without change in hardware.

BRIEF DESCRIPTION OF THE DRAWINGS

Further features of the invention will become apparent from the following description of a preferred embodiment with reference to the appending drawings. In the drawings.

DETAILED DESCRIPTION OF THE DRAWINGS

Figure 1:
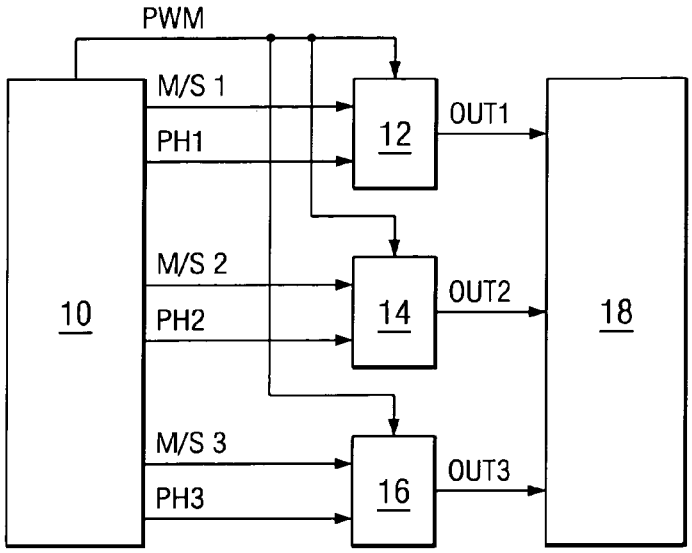
FIG. 1 is a block diagram of an inventive control device.

With reference to FIG. 1, which illustrates a 3-lamp backlight illumination system by way of an example, a display controller 10 has outputs to three identical lamp controllers 12, 14, and 16, each associated with a cold cathode fluorescent lamp in an illumination device 18. A first output is a common pulse-width modulated intensity control signal PWM. Master/slave control outputs M/S 1, M/S 2 and M/S 3 are applied to corresponding inputs of the lamp controllers 12, 14 and 16, respectively. Phase control outputs PH 1, PH 2 and PH 3 are applied to corresponding inputs of the lamp controllers 12, 14 and 16, respectively. Each lamp controller 12, 14, 16 has an output connected to a corresponding input of the illumination device 18.

Figure 2:
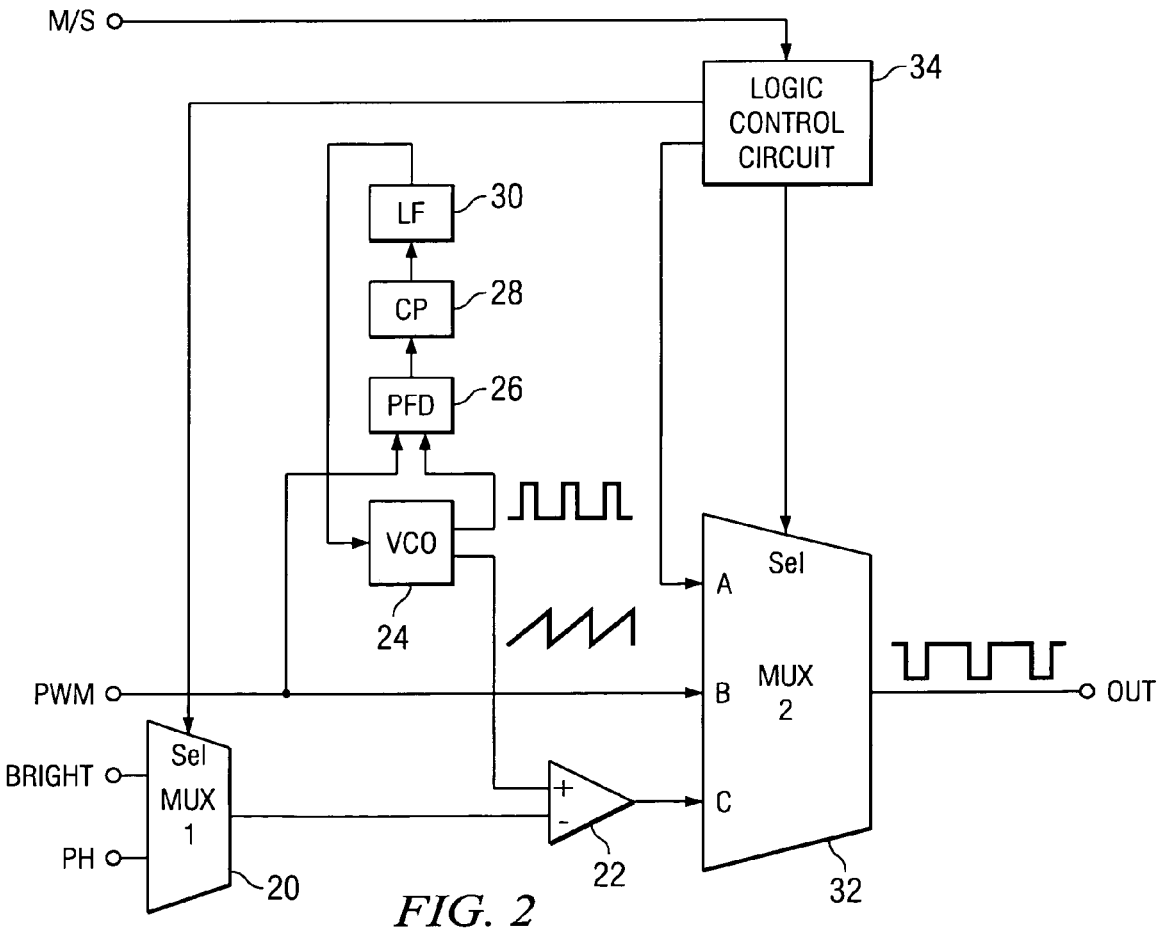
FIG. 2 is a block diagram of a lamp controller used in the device.

The lamp controller in FIG. 2 has a master/slave input M/S, an input PWM for the pulse-width modulated intensity control signal, and an input BRIGHT for a fixed intensity control signal and a phase control input PH. An input multiplexer 20 (MUX 1) has two signal inputs connected to inputs BRIGHT and PH, respectively, an output, and a select input. The output of multiplexer 20 is connected (optionally through a level shifter) to a first input of a comparator 22. A second input of comparator 22 is connected to an output of a voltage controlled oscillator (VCO) 24. The VCO supplies a saw-tooth output to the comparator 22 and is part of a phase lock loop with a phase-frequency detector (PFD) 26, a charge pump (CP) 28 and a loop filter (LF) 30. A pulse output from the VCO 24 is fed back to a feedback input of PFD 26, a reference input of which is connected to input PWM. The output of comparator 22 is connected to one input C of three signal inputs A, B, C of an output multiplexer (MUX 2) 32 that has an output OUT and a select control input Sel. Signal input B is connected to input PWM. A logic control circuit 34 has a first input connected to input M/S and a second input connected to input PWM. From a voltage applied to input M/S, the logic control circuit determines whether the lamp controller is to operate as master or as slave and applies on a first output a corresponding select control signal to the select control input Sel of MUX 2. The logic control circuit 34 includes circuitry to measure exactly the pulse duration of the PWM signal and has a second output connected to signal input A of MUX 2 to apply an end-of-pulse control signal. The logic control circuit 34 also includes circuitry to determine the presence of pulse-width modulation at input PWM and has a third output connected to the select control input Sel of input multiplexer (MUX 1) 20.

In operation, the lamp controller in FIG. 2 receives inputs M/S, PWM, BRIGHT and PH from the display controller 10 in FIG. 1. In the master mode, MUX 2 passes the PWM input to its output OUT. In the slave mode, VCO 24 locks to the PWM input. MUX 1 passes the PH input to the inverting input of comparator 22. The VCO saw-tooth output is applied to the non-inverting input of comparator 22. The output of comparator 22 then changes state at a point in the frame period determined by the level of the PH input. MUX 2 uses a rising edge received at its input C to start a pulse passed to its output OUT. The duration of the pulse is determined by the measurement of the pulse duration of the PWM signal. When an absence of pulse-width modulation at input PWM is detected by the logic control circuit 34, MUX 1 passes input BRIGHT to the inverting input of comparator 22, instead of input PH.

Figure 3:
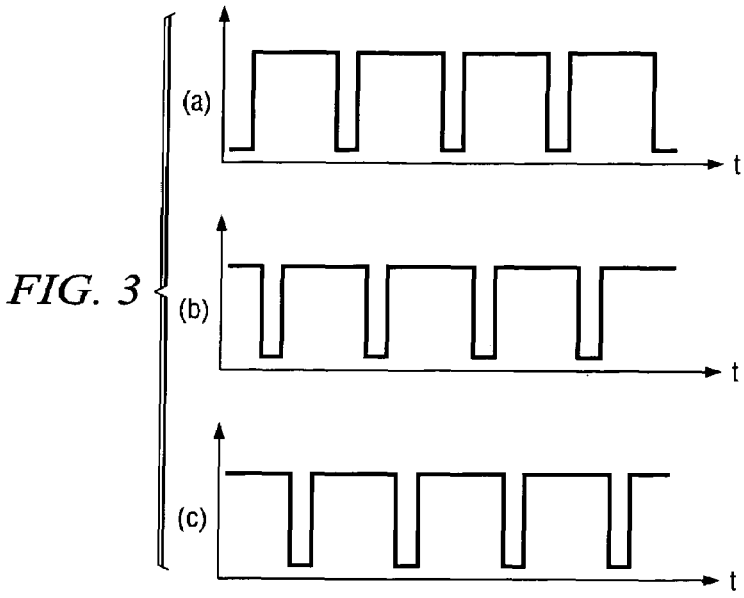
FIG. 3 is a signal diagram to illustrate the inventive method.

In the example illustrated in FIG. 3, trace (a) is the output OUT1 of lamp controller 12, which is assumed here to operate in a master mode. Accordingly, output OUT1 has the phase and duty-cycle of the intensity control signal PWM. In this example, it has a duty-cycle of 80%. Trace (b) is the output OUT2 of lamp controller 14, which is assumed to operate in a slave mode. The phase of OUT2 is shifted with respect to the phase of OUT1 by an amount determined by display controller 10. Trace (c) is the output OUT3 of lamp controller 16, which is also assumed to operate in a slave mode. The phase of OUT3 is shifted with respect to the phase of OUT1 by an amount determined by display controller 10, twice that of OUT3. As is seen in FIG. 3, the lamp activation pulses are evenly distributed within the display's frame period.

Figure 4:
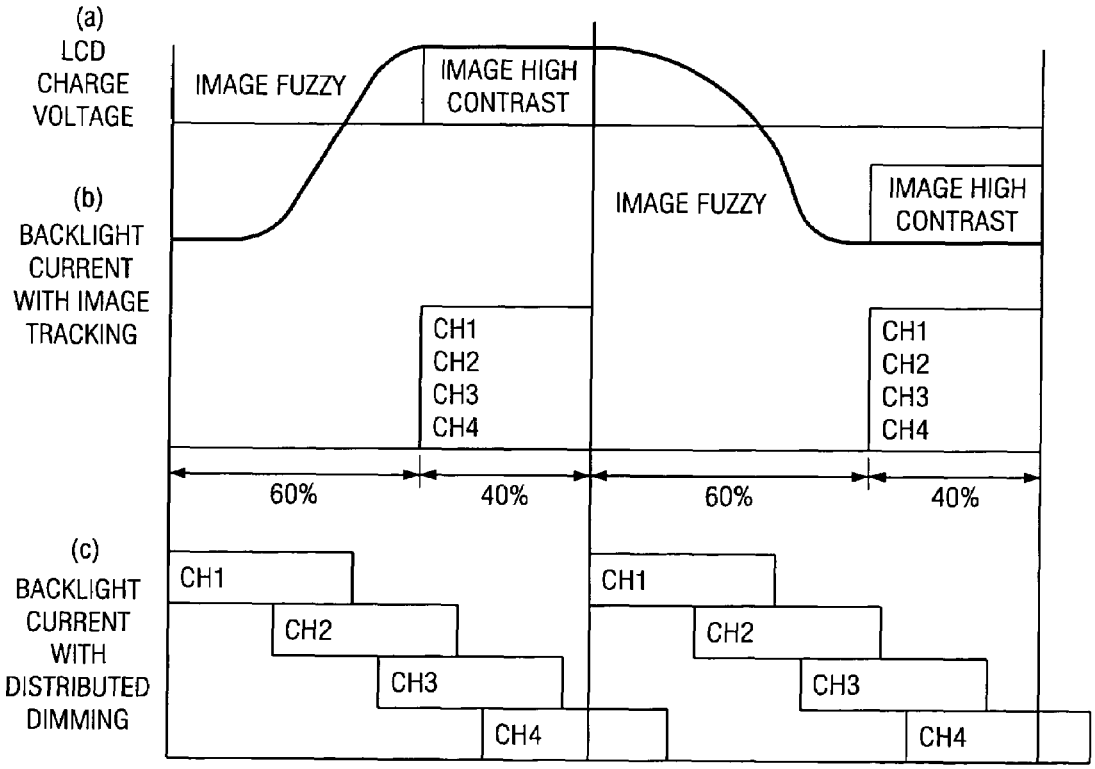
FIG. 4 is a signal diagram to illustrate another aspect of the inventive method.

The device of the present invention supports any phase relationship between the outputs of the lamp controllers. In an aspect of the inventive method illustrated in FIG. 4, any combination of patterns between "Image Tracking" and "Distributed Dimming" is allowed. In the example shown, the device has four channels, each with a lamp controller as described with reference to FIG. 2. Trace (a) in FIG. 4 shows an LCD charge voltage, trace (b) shows the phase relationship of the lamp currents in the four channels CH1 to CH4 at a 40% duty-cycle in a mode with image tracking, and trace (c) shows the phase relationship of the lamp currents in the four channels CH1 to CH4 at a 40% duty-cycle in a mode with distributed dimming. In both modes, the lamp currents of the channels may overlap each other. Between these ranges, any combination is allowed by the inventive method, and is supported by the inventive lamp controller.

The invention claimed is:

1. A method of controlling the light intensity in a multi-lamp illumination device for a display panel, comprising the steps of:

supplying a pulse-width modulated intensity control signal, a master/slave control signal and a phase control signal from a display controller to a plurality of lamp controllers, each lamp controller associated with a respective lamp of the display panel;

for each lamp controller;

switching the respective lamp controller between a master mode and a slave mode in response to the master/slave control signal using a logic control circuit;

providing a phase lock loop having an output that, in the slave mode, is locked to the intensity control signal;

multiplexing a lamp activation output so that, in the master mode, the intensity control signal is routed to the lamp activation output, and, in the slave mode, a signal is passed to the lamp activation output, the phase of which is determined by the output of a phase control circuit that receives as a first input the output of the phase lock loop and as a second input the phase control.

2. A device for controlling the light intensity in a multi-lamp illumination device for a display panel, comprising:

a display controller that supplies a pulse-width modulated intensity control signal;

a plurality of lamp controllers, each associated with a respective lamp of the display panel and each receiving the pulse-width modulated intensity control signal from the display controller; each lamp controller having:

a master/slave control input;

a phase control input;

a logic control circuit that switches the lamp controller between a master mode and a slave mode in response to the master/slave control signal;

an output multiplexer with a select input connected to a select control output of the logic control circuit, a plurality of signal inputs, and a lamp activation output; one of said signal inputs receiving the intensity control signal;

a phase lock loop with an output that, in the slave mode, is locked to the intensity control signal; and a phase control circuit with a first input connected to the output of the phase lock loop, a second input connected to the phase control input, and an output connected to a signal input of the output multiplexer;

the output multiplexer, in the master mode, routing the intensity control signal to the lamp activation output and, in the slave mode, passing to the lamp activation output a signal the phase of which is determined by the phase control circuit; and each lamp controller receiving a master/slave control signal and a phase control signal from the display controller.

3. The device of claim 2, wherein the logic control circuit has an input to which the intensity control signal is applied, circuitry to measure the pulse width of the intensity control signal, and an output connected to one of the inputs of the output multiplexer to supply an end-of-pulse control signal.

4. The device of claim 3, wherein the phase control circuit comprises a comparator and the phase lock loop provides a saw-tooth output applied to a first input of the comparator.

5. The device of claim 4, comprising an input multiplexer with a first signal input connected to the phase control input, a second signal input receiving a fixed intensity control signal, an output connected to a second input of the comparator, and a select control input connected to a select control output of the logic control circuit; wherein the logic control circuit applies a select control signal to the input multiplexer to pass the fixed intensity control signal in response to a detected intensity control signal that has no pulse-width modulation on it.

6. A lamp controller having:

a master/slave control input;

a phase control input;

a logic control circuit that switches the lamp controller between a master mode and a slave mode in response to the master/slave control signal;

an output multiplexer with a select input connected to a select control output of the logic control circuit, a plurality of signal inputs, and a lamp activation output; one of said signal inputs receiving the intensity control signal;

a phase lock loop with an output that, in the slave mode, is locked to the intensity control signal; and a phase control circuit with a first input connected to the output of the phase lock loop, a second input connected to the phase control input, and an output connected to a signal input of the output multiplexer;

the output multiplexer, in the master mode, routing the intensity control signal to the lamp activation output and, in the slave mode, passing to the lamp activation output a signal the phase of which is determined by the phase control circuit.

* * * * *